US008176838B2

(12) United States Patent
Walker

(10) Patent No.: US 8,176,838 B2
(45) Date of Patent: May 15, 2012

(54) HYDRAULIC MACHINE ARRANGEMENT

(76) Inventor: Frank H. Walker, Grand Blanc, MI (US)

( * ) Notice: Subject to any disclaimer, the term of this patent is extended or adjusted under 35 U.S.C. 154(b) by 448 days.

(21) Appl. No.: 12/524,633

(22) PCT Filed: Feb. 12, 2008

(86) PCT No.: PCT/US2008/053747

§ 371 (c)(1),
(2), (4) Date: Jul. 27, 2009

(87) PCT Pub. No.: WO2008/100953

PCT Pub. Date: Aug. 21, 2008

(65) Prior Publication Data

US 2010/0101406 A1 Apr. 29, 2010

Related U.S. Application Data

(60) Provisional application No. 60/900,775, filed on Feb. 12, 2007, provisional application No. 60/921,279, filed on Apr. 2, 2007.

(51) Int. Cl.
*F01B 1/06* (2006.01)

(52) U.S. Cl. ..... 91/491; 91/492; 91/489; 92/72

(58) Field of Classification Search ..... 91/476, 91/488, 489, 491, 492; 92/72
See application file for complete search history.

(56) References Cited

U.S. PATENT DOCUMENTS 3,493,066 A 2/1970 Dooley
3,734,222 A 5/1973 Bardwick, III
3,760,691 A 9/1973 Kleckner et al.
3,796,136 A 3/1974 Oguni
3,852,998 A 12/1974 Leeson
3,908,519 A 9/1975 Born et al.
3,910,043 A 10/1975 Clerk
3,941,498 A 3/1976 Duckworth et al.
4,031,420 A 6/1977 Carini (Continued)

FOREIGN PATENT DOCUMENTS

DE 3538547 A1 5/1987

(Continued)

OTHER PUBLICATIONS

Design News, "Hydraulic Motor Adds Speed Equipment", Apr. 26, p. #38.

(Continued)

*Primary Examiner* — Charles Freay
*Assistant Examiner* — Todd D Jacobs
(74) *Attorney, Agent, or Firm* — Brooks Kushman, P.C.

(57) ABSTRACT

A hydraulic machine arrangement includes at least one hydraulic machine having a plurality of pistons reciprocating within corresponding cylinders. The pistons can be driven by a cam to operate the hydraulic machine as a pump, and they can drive the cam to operate the hydraulic machine as a motor. The hydraulic machine can be configured to selectively disengage a certain piston or pistons from the cam to operate at less than full displacement. Controlling the pressure in the cylinders corresponding to the disengaged pistons can be accomplished by a number of mechanisms, including selectively exhausting fluid from the cylinders, or using a jet pump to siphon off some of the fluid from a high pressure side of the hydraulic machine. Two of the hydraulic machines can be mounted together to help balance axial forces and eliminate the need for an expensive high capacity thrust bearing.

21 Claims, 8 Drawing Sheets

U.S. PATENT DOCUMENTS

| | | | | |
|---|---|---|---|---|
| 4,051,765 | A | 10/1977 | Saito | |
| 4,208,921 | A | 6/1980 | Keyes | |
| 4,282,948 | A | 8/1981 | Jerome | |
| 4,297,086 | A | 10/1981 | McGowan | |
| 4,459,084 | A * | 7/1984 | Clark | 417/11 |
| 4,540,345 | A | 9/1985 | Frazer | |
| 4,883,141 | A | 11/1989 | Walker | |
| 4,934,251 | A | 6/1990 | Barker | |
| 4,993,780 | A | 2/1991 | Tanaka et al. | |
| 5,000,282 | A | 3/1991 | Walker | |
| 5,101,925 | A | 4/1992 | Walker | |
| 5,211,015 | A | 5/1993 | Schroeder | |
| 5,215,124 | A | 6/1993 | Hattori et al. | |
| 5,263,401 | A | 11/1993 | Walker | |
| 5,323,688 | A | 6/1994 | Walker | |
| 5,473,893 | A | 12/1995 | Achten et al. | |
| 5,482,445 | A | 1/1996 | Achten et al. | |
| 5,507,144 | A * | 4/1996 | Gray et al. | 60/327 |
| 5,540,193 | A | 7/1996 | Achten et al. | |
| 5,556,262 | A | 9/1996 | Achten et al. | |
| 5,829,393 | A | 11/1998 | Achten et al. | |
| 5,839,889 | A | 11/1998 | Folsom et al. | |
| 5,944,493 | A | 8/1999 | Albertin et al. | |
| 5,971,092 | A | 10/1999 | Walker | |
| 5,983,638 | A | 11/1999 | Achten et al. | |
| 6,024,420 | A | 2/2000 | Yonemura et al. | |
| 6,033,040 | A | 3/2000 | Inagaki et al. | |
| 6,116,138 | A | 9/2000 | Achten | |
| 6,116,871 | A | 9/2000 | Back'e et al. | |
| 6,142,581 | A | 11/2000 | Yamaguchi et al. | |
| 6,206,656 | B1 | 3/2001 | Bailey et al. | |
| 6,223,529 | B1 | 5/2001 | Achten | |
| 6,279,517 | B1 | 8/2001 | Achten | |
| 6,336,518 | B1 | 1/2002 | Matsuyama | |
| 6,349,543 | B1 | 2/2002 | Lisniansky | |
| 6,374,602 | B1 | 4/2002 | Prabhu et al. | |
| 6,446,435 | B1 | 9/2002 | Willmann et al. | |
| 6,470,677 | B2 | 10/2002 | Bailey | |
| 6,537,047 | B2 | 3/2003 | Walker | |
| 6,575,076 | B1 | 6/2003 | Achten | |
| 6,623,260 | B2 | 9/2003 | White | |
| 6,641,232 | B1 | 11/2003 | Alaze | |
| 6,719,080 | B1 | 4/2004 | Gray, Jr. | |
| 6,758,295 | B2 | 7/2004 | Fleming | |
| 6,773,368 | B1 | 8/2004 | Williames | |
| 6,811,510 | B1 | 11/2004 | Langenfeld et al. | |
| 6,905,321 | B2 | 6/2005 | Uchiyama et al. | |
| 7,562,944 | B2 | 7/2009 | Walker | |
| 7,926,605 | B1 | 4/2011 | Otterstrom | |
| 2001/0036411 | A1 | 11/2001 | Walker | |
| 2002/0043884 | A1 | 4/2002 | Hunter | |
| 2002/0163173 | A1 | 11/2002 | Ruehl et al. | |
| 2006/0055238 | A1 * | 3/2006 | Walker | 303/152 |
| 2006/0061080 | A1 | 3/2006 | Luttinen et al. | |
| 2008/0210500 | A1 | 9/2008 | Walker | |
| 2010/0101406 | A1 | 4/2010 | Walker | |

FOREIGN PATENT DOCUMENTS

| | | | |
|---|---|---|---|
| JP | 57127154 | A | 8/1982 |
| JP | 63085265 | A | 4/1988 |
| JP | 8-144927 | A | 6/1996 |
| WO | 2006066156 | A2 | 6/2006 |

OTHER PUBLICATIONS

Peter A.J. Achten et al., Transforming Future Hydraulics: A New Design of a Hydraulic Transformer, Abstract, reprint from Proceedings of the Fifth Scandinavian International Conference on Fluid Power, 1997, part 3, Linköping University, 1 page.

Peter A.J. Achten et al., What a Difference a Hole Makes—The Commercial Value of the Innas Hydraulic Transformer, Abstract, The Sixth Scandinavian International Conference on Fluid Power, May 26-29, 1999, Tampere, Finland, 1 page.

Georges Vael et al., Cylinder Control With the Floating Cup Hydraulic Transformer, The Eighth Scandinavian International Conference on Fluid Power, May 7-9, 2003, Tampere, Finland, 16 pages.

Peter Achten et al., Design and Testing of an Axial Piston Pump Based on the Floating Cup Principle, The Eighth Scandinavian International Conference on Fluid Power, May 7-9, 2003, Tampere, Finland, 16 pages.

Rob A.H. van Malsen et al., Design of Dynamic and Efficient Hydraulic Systems Around a Simple Hydraulic Grid, 2002, SAE 2002-01-1432, pp. 1-9.

Georges E.M. Vael et al., The Innas Hydraulic Transformer—The Key to the Hydrostatic Common Pressure Rail, 2000, SAE 2000-01-2561, 16 pages.

R. P. Kepner, Hydraulic Power Assist—A Demonstration of Hydraulic Hybrid Vehicle Regenerative Braking in a Road Vehicle Application, SAE Technical Paper Series, 2002, SAE 2002-01-3128, 8 pages.

Peter A.J. Achten et al., 'Shuttle' technology for noise reduction and efficiency improvement of hydrostatic machines, The Seventh Scandinavia International Conference on Fluid Power, 2001, Linköping, Sweden, pp. 1-4.

Peter A.J. Achten et al., Valving Land Phenomena of the Innas Hydraulic Transformer, Abstract, 1 page. enomena of the Innas Hydraulic Transformer, Abstract, 1 page.

G.E.M. Vael et al., Some Design Aspects of the Floating Cup Hydraulic Transformer, 16 pages.

Peter A.J.Achten, Designing the impossible pump, pp. 1-15.

* cited by examiner

HYDRAULIC MACHINE ARRANGEMENT

CROSS-REFERENCE TO RELATED APPLICATIONS

This application claims the benefit of U.S. provisional application Ser. No. 60/900,775 filed 12 Feb. 2007, and U.S. provisional application Ser. No. 60/921,279 filed 2 Apr. 2007, each of which is hereby incorporated herein by reference.

BACKGROUND OF THE INVENTION

1. Field of the Invention

The present invention relates to a hydraulic machine arrangement, and in particular, a hydraulic machine arrangement including at least one hydraulic machine that may operate as a pump, a motor, or both.

2. Background Art

It is well known that hydraulic regenerative systems promise improved efficiency over electric regenerative systems incorporating a battery. Hydraulic regeneration involves using a pump connected in the vehicle drive train as a retarding device, and then storing the resulting high pressure fluid in an accumulator. On subsequent vehicle acceleration, the high pressure fluid from the accumulator is routed to a hydraulic motor and the stored energy is recovered in the form of mechanical work which drives the vehicle forward. A low pressure accumulator acts as a reservoir to make up for fluid volume variations within the high pressure accumulator, and also provides a charge pressure to the inlet side of the pump. Integral to a system such as this are hydraulic machines—i.e., hydraulic pumps, motors, or machines that can operate as both a pump and a motor as desired.

One method of modulating braking and driving forces in hydraulic regenerative systems is to incorporate a variable displacement hydraulic machine to operate in concert with an accumulator whose pressure is a function of its state of charge. Conventional variable displacement hydraulic machines may vary the piston strokes to achieve the desired power modulation. Such devices can be bulky, heavy and expensive. Moreover, they do not package easily in automotive passenger vehicles, especially in the front of a vehicle, where space is limited.

One way to overcome the limitations associated with conventional variable displacement hydraulic machines is to use a fixed displacement machine. Such a machine is generally smaller and lighter than its variable displacement counterpart, but it does not allow the power modulation required in most applications. One solution to this problem is to use a fixed displacement hydraulic machine in conjunction with a variable ratio hydraulic transformer to facilitate the desired power modulation. Systems utilizing transformers such as these are described in U.S. patent application Ser. No. 10/535,354, entitled "Hydraulic Regenerative Braking System for a Vehicle," filed on 18 May 2005, now U.S. Pat. No. 7,562,944, which is hereby incorporated herein by reference.

As an alternative to a transformer, it may be desirable to have a system that included a relatively compact variable displacement hydraulic machine, thus eliminating the requirement of a separate variable ratio transformer. Variable displacement hydraulic machines are described in U.S. patent application Ser. No. 11/721,903, entitled "Hydraulic Regenerative Braking System and Method for a Vehicle," filed on 15 Jun. 2007, published as US 2008/0185909 and U.S. patent application Ser. No. 11/913,971, entitled "Hydraulic Regenerative Braking System for a Vehicle," filed on 9 Nov. 2007, published as US 2008/0210500, each of which is hereby incorporated herein by reference.

SUMMARY OF THE INVENTION

Embodiments of the present invention provide a hydraulic machine arrangement including at least one hydraulic machine operable as a motor, a pump, or both. In particular, embodiments of the present invention may operate as a motor, such that hydraulic pressure is provided as an input, and torque is provided as an output. Other embodiments may receive torque as an input—e.g., the rotational force of a vehicle axle or drive shaft—and provide increased hydraulic pressure as an output. Embodiments of the present invention may be selectively operable as a motor in one mode and as a pump in another.

Embodiments of the invention may also provide a hydraulic machine arrangement that includes at least one hydraulic machine operable as a pump configured to be driven by a shaft, thereby increasing the pressure of fluid flowing through the hydraulic machine. The hydraulic machine may further be operable as a motor configured to be driven by pressurized fluid, thereby providing torque to the shaft. Such a hydraulic machine may include a port housing having a high pressure fluid port and a low pressure fluid port, and a cylinder block having a plurality of radial pistons. Each of the pistons is configured to reciprocate within a corresponding cylinder in the cylinder block, and has a corresponding piston stroke. The pistons pump fluid when the hydraulic machine is operating as a pump, and provide torque when the hydraulic machine is operating as a motor.

Each of the pistons includes a corresponding cam follower. A cam is disposed at least partly within the cylinder block, and has a plurality of lobes configured to cooperate with the cam followers to translate rotational motion of the cam into linear motion of the pistons when the hydraulic machine is operating as a pump, and to translate linear motion of the pistons into rotational motion of the cam when the hydraulic machine is operating as a motor. A valve plate includes a plurality of apertures therethrough, at least one of which communicates with the high pressure fluid port and at least one of which communicates with the low pressure fluid port. The valve plate is configured to connect at least one of the cylinders with the high pressure fluid port and at least one other of the cylinders with the low pressure fluid port.

The valve plate is movable relative to the port housing to effect a first transition to disconnect the at least one cylinder from the high pressure fluid port and connect it with the low pressure fluid port, and to effect a second transition to disconnect the at least one other cylinder from the low pressure fluid port and connect it with the high pressure fluid port. In some embodiments, the valve plate is movable such that the first and second transitions can be effected at a plurality of piston positions within a corresponding piston stroke, thereby facilitating variable displacement operation of the hydraulic machine. In still other embodiments, variable displacement is achieved by disengaging one or more of the pistons, and in some embodiments, a combination of a movable valve plate and piston disengagement may be utilized.

Disengaging one or more of the pistons to operate the machine at less than full displacement may provide efficiency gains over other configurations for varying the displacement. The disengagement of one or more of the pistons may be effected in any of a number of different ways. For example, for a hydraulic machine operating as a motor, one method involves disengaging the non-driving pistons by increasing the pressure in the housing—i.e., the case pressure—to be equal with the return pressure. This balances the hydraulic forces on the piston, and allows the centrifugal force to dominate, thereby keeping the deactivated pistons in the outer retracted position separated from the cam during particular segments of the rotation. If accumulators are used in a regenerative installation, then the return pressure and the case pressure will be set by the pressure in the low pressure accumulator. It should be noted that the disengagement is synchronized with particular cam lobes, not particular cylinders, so the disengaged cylinders alternate as they pass by the continuously low pressure ports synchronized to a particular set of cam lobes.

Another configuration that can be used in embodiments of the present invention, involves disengaging the non-driving pistons of a hydraulic machine operating as a motor by decreasing the return pressure to near zero to equal the case pressure. This may be accomplished, for example, by using a high capacity pump, such as a jet pump, in the main flow circuit to pump the near zero return pressure back up to the low pressure accumulator pressure level. Systems of this type have the advantage of allowing partial evacuation of the case with the rotating cylinder block inside, allowing just enough fluid to keep the piston/cam rollers splash lubricated and lifted off their plain bearing in the power piston. Efficiency of jet pumps is affected by the location, size, and shape of the jets as they redirect some of the output flow back to the inlet passage. Control can be attained by use of a proportional valve capable of throttling the redirected flow.

Other embodiments may connect the ports for both power and return to exhaust passages, for example, with individual two-way poppet valves. For a 9 lobe cam, there are 18 feed ports corresponding to the 18 cam ramps. The distribution of the 18 cam ramps can be, for example, as follows: 3 equally spaced deep down ramps, 3 equally spaced deep up ramps, 3 equally spaced medium down ramps, 3 equally spaced medium up ramps, 3 equally spaced shallow down ramps, 3 equally spaced shallow up ramps. In one embodiment, the deep down and up ramps may have a stroke of approximately 0.220 inches, the medium down and up ramps a stroke of approximately 0.098 inches, and the shallow down and up ramps a stroke of approximately 0.061 inches. For pump mode operation, the up ramps are connected to the high pressure ports and the down ramps are connected to the low pressure ports. For motor mode, the port housing, or manifold, which contains the ports is indexed relative to the cam, such that the down ramps are connected to the high pressure ports and the up ramps are connected to the low pressure ports.

To provide smooth and quiet operation of a hydraulic machine arrangement, embodiments of the present invention may provide cam lobes that are specifically configured such that the sum of the velocity curves for all the lobes is a straight line. The nose radius of the cam lobes may also be equal to or greater than the radius of the cam follower, or roller, to reduce Hertz stress. Embodiments of the invention also provide piston velocity profiles that are compatible with the flow area of the hydraulic fluid as the valve plate opening varies from fully closed to fully open, and back again. Thus, cams for hydraulic machine arrangements of the present invention may be configured such that the maximum piston velocity occurs when the flow area is near a maximum, not, for example, when the port is at the cracking point—i.e., just opening—and the flow area is near a minimum.

In embodiments of the hydraulic machines described above, high pressure fluid may enter the machine through a port housing, thereby imparting an axial load on at least a portion of the machine. In order to balance the force caused by the high pressure fluid, a large tapered roller bearing can be used. Such a solution has some disadvantages, however, in that such bearings tend to be expensive and occupy a large amount of space, as well as incurring parasitic losses associated with the rolling friction of high loads. As an alternative to using the large tapered roller bearing, embodiments of the present invention add a pressure balance area on the cylinder block on the opposite face from the direction of the fluid load. High pressure fluid is fed to a floating piston, such that the majority of the thrust load can be balanced hydraulically, and only a small portion of the thrust load transmitted to a lighter duty roller, ball, or journal bearing.

The balance piston described above is configured such that the area separating the piston face from the cylinder block is slightly larger than the area applying the piston. An orifice or restricted flow passage in the piston causes a pressure drop through the piston such that the pressure drop is proportional to the square of the flow velocity through the passage. This allows the balance piston to find a position such that the feed pressure times the applied area equals the separating area times the reduced pressure. The balance piston position is self-regulating. If leakage increases, the separating pressure drops, and the piston moves to decrease the leakage. Conversely, if leakage decreases, the separating pressure increases, and the piston moves to increase the leakage. In summary, the balance force on the cylinder block face is equal to the feed pressure times the applied area of the balance piston. The design of the flow restrictor is adjusted to minimize the loss due to high pressure fluid leakage while maintaining a film of fluid between the rotating cylinder block and the stationary balance piston.

With a multi-speed hydraulic machine, it may be desirable to have more than one balance piston. In such a configuration, each of the balance pistons can balance a proportional share of the unbalanced thrust load. For example, with the seven speed, 9 lobe, 13 piston machine described above, three balance pistons may be used. Each of the balance pistons connects with a feed passage through which it receives high pressure fluid. By having separate feed passages, one of the balance pistons is operational when one bank of cam lobes is operational, two of the balance pistons are operational when two bank of the cam lobes are operational, and all of the balance pistons are operational when the hydraulic machine is operating at full capacity.

Another way to balance some of the high axial forces induced in hydraulic machines of this type, is to configure a hydraulic machine arrangement with two hydraulic machines mounted back-to-back. Such an arrangement may be particularly well suited for mounting motors, particularly for automotive vehicles where two motors are used to drive two axle shafts. By mounting the motors back-to-back in a single housing, heavy duty bearings and balance pistons may be eliminated. manifold in a radial piston motor or pump. The thrusts of the two machines balance each other, and because there is minimum relative speed between the two axles, a plain thrust washer or rolling element thrust washer can withstand the high thrust loads which otherwise might require a high capacity tapered roller thrust bearing.

DETAILED DESCRIPTION OF THE EMBODIMENTS OF THE INVENTION

Figure 1:
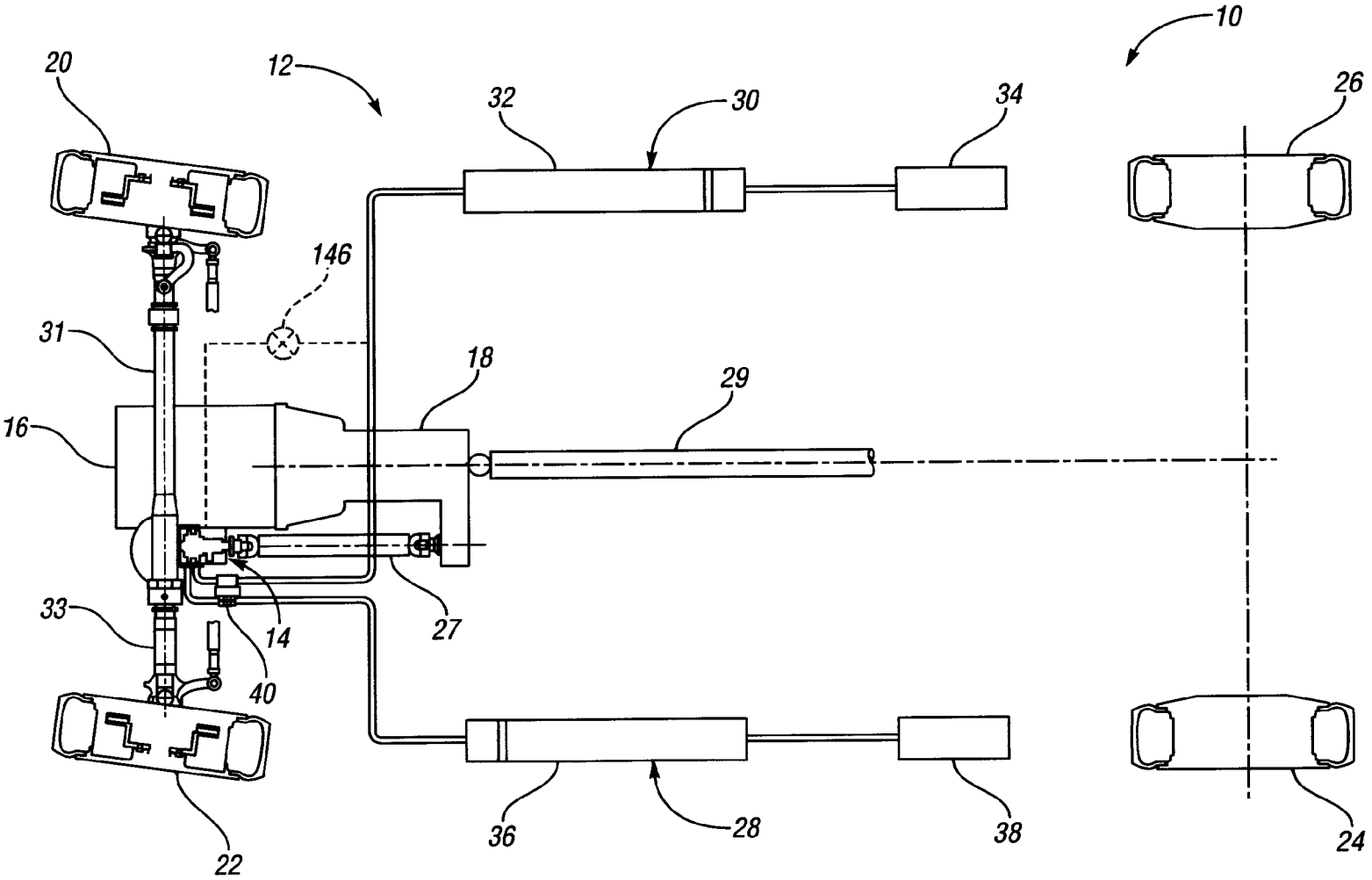
FIG. 1 is a schematic representation of a hydraulic energy recovery system including a hydraulic machine arrangement in accordance with one embodiment of the present invention.

FIG. 1 shows a schematic representation of a vehicle 10, having a hydraulic energy recovery system 12, including a hydraulic machine arrangement 14 in accordance with one embodiment of the present invention. The vehicle 10 includes an engine 16, a transmission 18, a transfer case 19, and four wheels 20, 22, 24, 26. The hydraulic machine arrangement 14 is connected to a front drive shaft 27. The hydraulic machine arrangement 14 is operable to pump fluid into a first, or high pressure accumulator 28, where the high pressure fluid is stored for later use. The hydraulic machine arrangement 14 is also operable as a motor, driven by fluid from the high pressure accumulator 28. Thus, the energy stored in the high pressure accumulator 28 during a braking or other driving event is used to operate the hydraulic machine arrangement 14 as a motor to provide torque to the wheels 20, 22 during a driving event.

The energy recovery system 12 illustrated and described herein is just one use for a hydraulic machine arrangement in accordance with the present invention. It is understood that such hydraulic machine arrangements may be used for other applications—e.g., they may be used exclusively as motors to provide torque, or exclusively as pumps to provide pressurized fluid. In addition, hydraulic machine arrangements, such as the hydraulic machine arrangement 14, may be mounted in different locations on a vehicle, for example, on drive shaft 29, the transfer case 19, or half axle shafts 31, 33, illustrated in FIG. 1.

The energy recovery system 12 also includes a second, or low pressure accumulator 30. The low pressure accumulator 30 provides a charge pressure—i.e., a relatively low pressure—to the hydraulic machine arrangement 14 to help ensure that there is always some liquid supplied to the hydraulic machine arrangement 14, thereby avoiding cavitation. The low pressure accumulator 30 may include two parts: a liquid/gas container 32, and a gas only container 34. Similarly, the high pressure accumulator 28 may include two parts: a liquid/gas container 36, and a gas only container 38. Configuring each of the accumulators 28, 30 with two containers facilitates packaging by reducing the size of each liquid/gas container 32, 36. Of course, high and low pressure accumulators, such as the high and low pressure accumulators 28, 30, may include a single liquid/gas container, rather than the two-part configuration shown in FIG. 1. The gas bottles 34 and 38 can be incorporated in other vehicle components such as tubular engine mounts, frame cross members, or tubular running boards used on many light duty trucks.

The energy recovery system 12 also includes a control system, shown in FIG. 1 as a control module 40. The control module 40 receives inputs related to operation of the vehicle, and uses these inputs to control operation of the hydraulic machine arrangement 14. Such inputs may include driver initiated acceleration requests and braking requests, which may be input directly into the control module 40, or may be input from another controller, such as a vehicle system controller. In addition to electronic inputs, the control module 40 may also receive a number of hydraulic inputs (removed in FIG. 1 for clarity) to detect various fluid pressures in the system 10, and to help control operation of the hydraulic machine arrangement 14.

When the control module 40 is signaled to use regenerative braking during a braking event, it sends a control pressure to the hydraulic machine arrangement 14 to ensure that the hydraulic machine arrangement 14 operates as a pump. Conversely, when the control module 40 is signaled to provide torque to the wheels 20, 22 during a driving event, it sends a control pressure to the hydraulic machine arrangement 14 to ensure that the hydraulic machine arrangement 14 operates as a motor. In this mode, fluid from the high pressure accumulator 28 drives the hydraulic machine arrangement 14 such that torque is provided to the wheels 20, 22.

In another operating scenario, the energy recovery system 12 can be used to store energy when driving the vehicle. High powered internal combustion (IC) engines can be inefficient when operating below approximately 70% of full torque, and efficiency continues to decrease as the torque decreases further. For modern vehicles, highway driving typically operates the engine at 12% to 30% of full torque. Using a hydraulic energy recovery system, such as the system 12, the IC engine can be operated intermittently, within the operating speeds of the hydraulic machinery, at near full torque while storing the excess energy in the high pressure accumulator. When a control system, such as the control module 40, detects that the accumulator is near its maximum pressure, the IC engine is idled, and cylinders are deactivated or shut off, while the vehicle is driven from the stored energy. When the high pressure accumulator is depleted, the control system reactivates the IC engine, and the cycle starts over again. With refined controls, the cycling can become transparent to the vehicle driver.

Figure 2B:
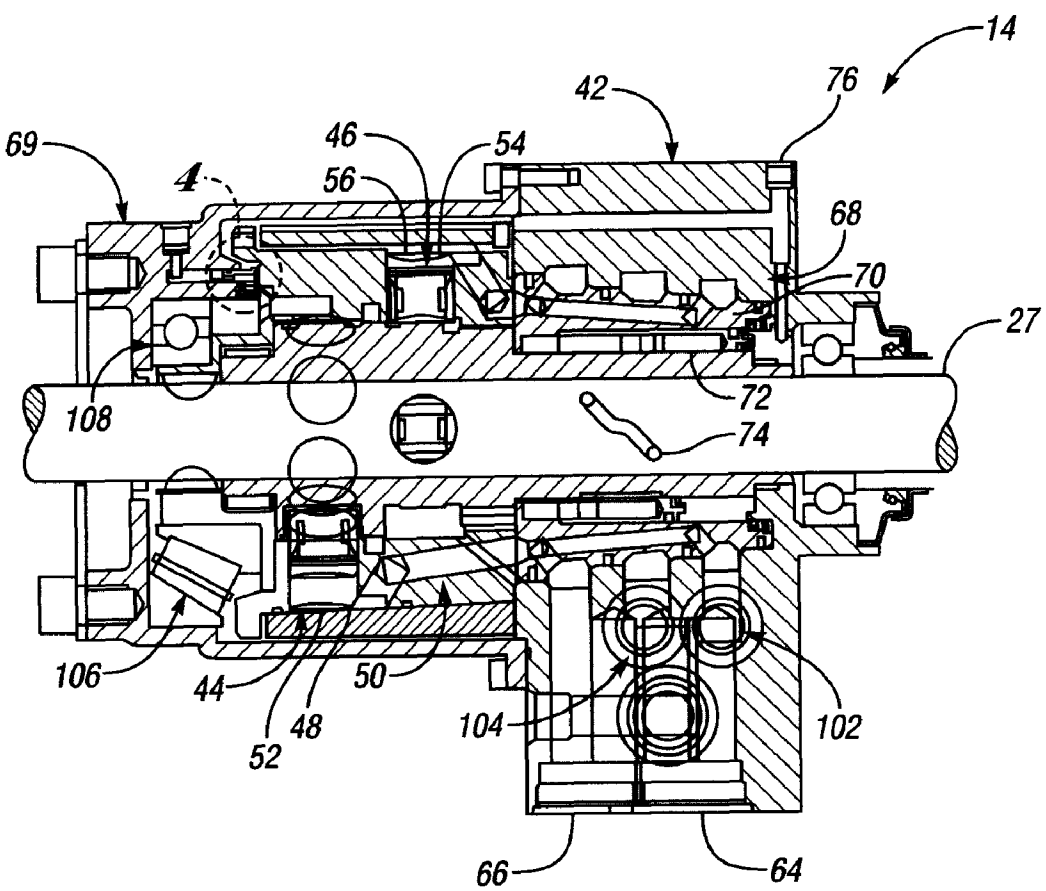
FIGS. 2A-2B are sectional views of a hydraulic machine used with the system shown in FIG. 1.
Figure 2A:
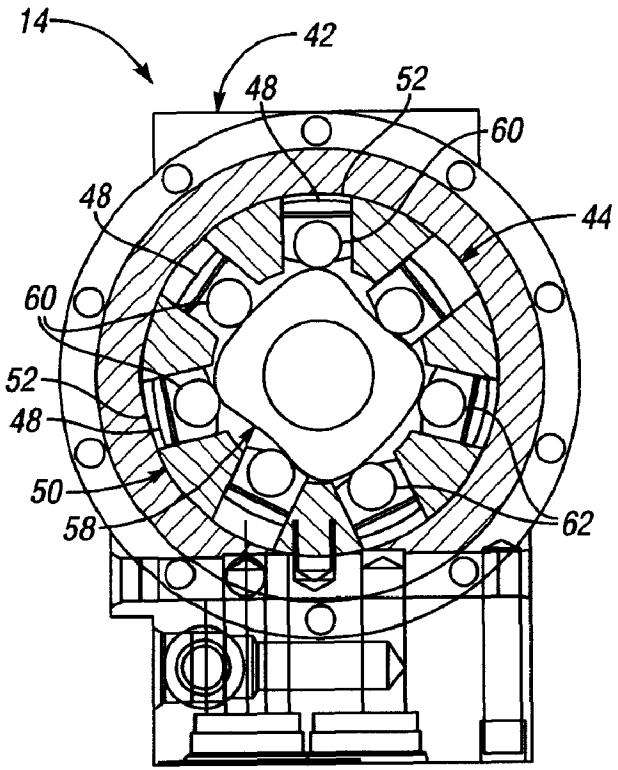

FIGS. 2A and 2B show sectional views of the hydraulic machine arrangement 14, which, in the illustrated embodiment, includes a single hydraulic machine 42. FIG. 2B shows a side cross-sectional view of the hydraulic machine 42, which includes two banks 44, 46 of piston/cylinder combinations. As discussed above, hydraulic machines in accordance with the present invention can be configured with different numbers of piston/cylinder combinations, as desired. As shown in FIG. 2A, the first bank 44 includes seven pistons 48 radially oriented around a cylinder block 50, which has cylinders 52 disposed therein. The cylinder block 50 is splined or keyed to the shaft 27, shown in FIG. 1. Although only one piston 54 is shown in the second bank 46 in FIG. 2B, it is understood that the second bank 46 also includes seven of the pistons 54 radially oriented around the cylinder block 50, and each of the pistons 54 travels within a corresponding cylinder 56.

The hydraulic machine 42 also includes a cam 58 having an aperture 60 configured to allow the shaft 27 to pass therethrough. Thus, the shaft 27 turns the cylinder block 50, while the cam 60 is stationary. Riding on the cam 60 are cam followers 62, which cooperate with the pistons 48, 54 to operate the pistons 48, 54 to pump fluid to the hydraulic machine 42 when it is operating as a pump. Conversely, when the hydraulic machine 42 is operating as a motor, it receives high pressure fluid from the accumulator 28, and outputs torque to the shaft 27.

Returning to FIG. 2B, it is shown that the hydraulic machine 42 includes a high pressure port 64 and a low pressure port 66 disposed within port housing 68. The high and low pressure fluid ports 64, 66 are respectively connected to the high and low pressure accumulators 28, 30, shown in FIG. 1. Although FIG. 2B shows the high pressure fluid port 64 connected only to the cylinders 52 in the first bank 44, and the low pressure fluid port 66 is shown in FIG. 2B connected only to the cylinders 56 in the second bank 46, it is understood that both the high and low pressure fluid ports 64, 66 are connected to the cylinders 52, 56 in each of the banks 44, 46. Attached to the port housing 68 and surrounding the cylinder block 50 is an outer housing 69.

In order to facilitate a connection between the cylinders 52, 56 and the high and low pressure fluid ports 64, 66, the hydraulic machine 42 includes a valve plate 70. The valve plate 70 also remains relatively stationary, like the cam 58, while the cylinder block 50 rotates with the shaft 27. The port housing 68 and the outer housing 69 are also stationary. It is worth noting that in other embodiments, a cam and valve plate, such as the cam 58 and the valve plate 70, may be configured to rotate with a shaft, such as the shaft 27, while a respective cylinder block is stationary. In either case, the valve plate 70 is movable relative to the cam 58, which allows the hydraulic machine 42 to switch from a pump to a motor, and vice versa.

When the hydraulic machine 42 is operating as a pump, cylinders 52, 56 will be connected to the high pressure fluid port 64 when a corresponding piston 48, 54 is in an outstroke. Conversely, when the pistons 48, 54 are in an instroke, their respective cylinders 52, 56 will be connected to the low pressure fluid port 66. In order to change the operation of the hydraulic machine 42 from a pump to a motor, the valve plate 70 is rotated relative to the cam 58, such that the fluid connections to the cylinders 52, 56 are reversed. Specifically, when the hydraulic machine 42 is operating as a motor, the cylinders 52, 56 will be connected to the high pressure fluid port 64 when their respective pistons 48, 54 are in an instroke, and they will be connected to the low pressure fluid port 66 when their respective pistons 48, 54 are in an outstroke.

In order to effect movement of the valve plate 70 relative to the cam 58, the hydraulic machine 42 includes an axial piston 72. The piston 72 drives the valve plate 70 via a link (not shown) attached to the valve plate 70 and riding in a slot 74 disposed in the shaft 27. The movement of the link in the slot 74 translates the linear movement of the axial piston 72 into rotational movement of the valve plate 70. Movement of the axial piston 72 in one direction is effected by fluid entering a mode port 76 located in the port housing 68. A spring (not shown) is provided to return the axial piston 72 to its previous position when the fluid pressure from the mode port 76 is exhausted. In other embodiments, other actuators, such as a tangential piston 77—shown in phantom in FIG. 5—may be used in place of the axial piston 72 to control rotation of the valve plate 70.

Figure 3B:
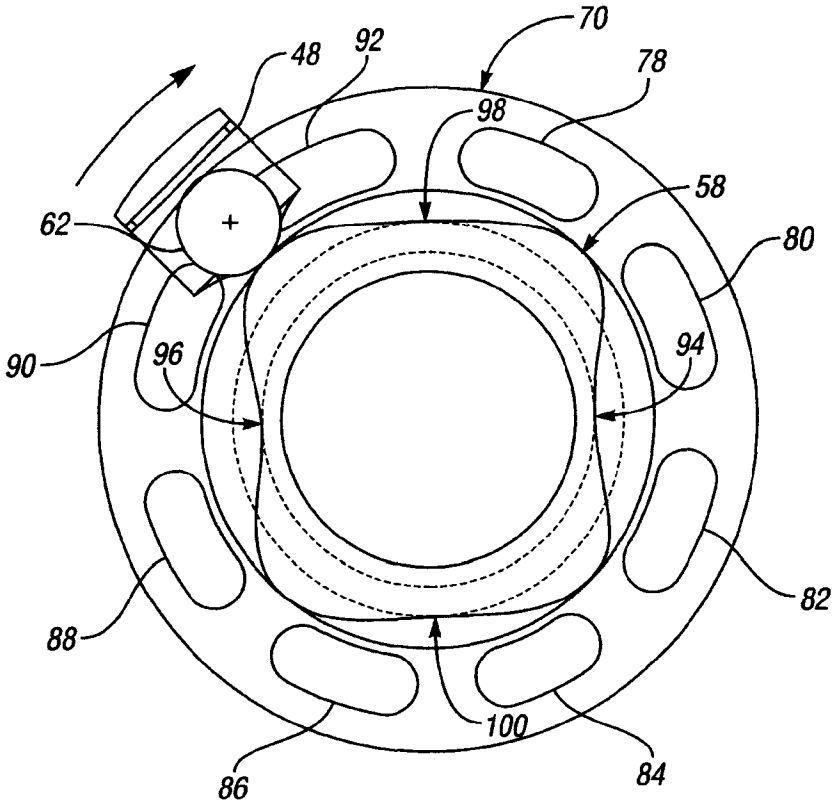
FIGS. 3A-3B are detailed views of components of the hydraulic machine shown in FIGS. 2A and 2B
Figure 3A:
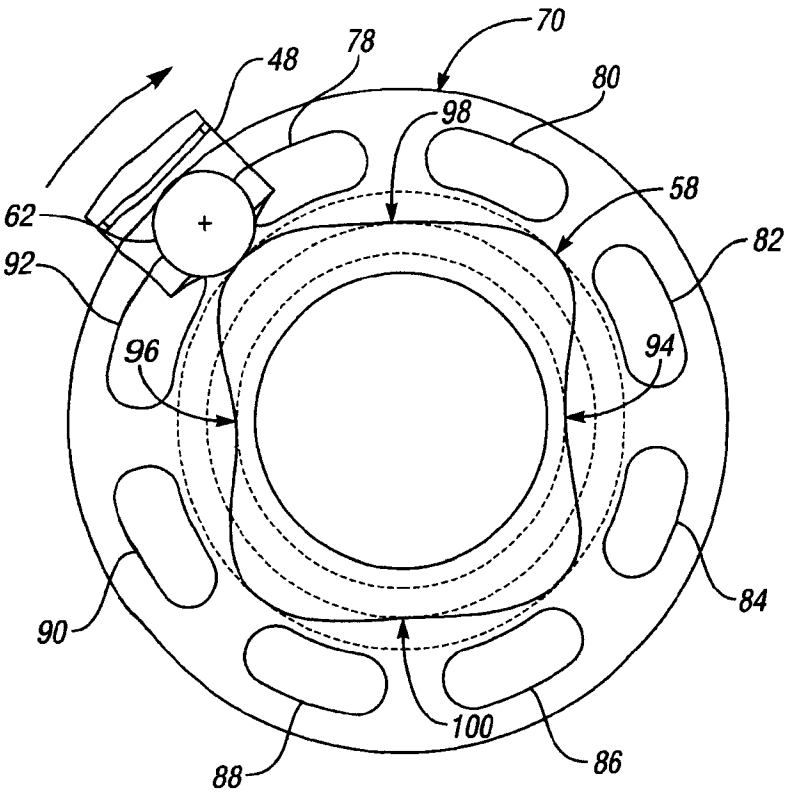

In order to the facilitate a connection between the high and low pressure ports 64, 66 and the cylinders 52, 56, the valve plate 70 includes a number of apertures or ports 78, 80, 82, 84, 86, 88, 90, 92—see FIGS. 3A and 3B. In FIG. 3A, the hydraulic machine 42 is operating in a motor mode. Two sets of ports 78, 86 and 82, 90 can communicate with the high or low pressure ports 64, 66 depending on the displacement required.

As shown in FIG. 3A, a piston 48 and a cam follower 60 move around the cam 58 in a clockwise direction. The cam 58 is configured with four lobes 94, 96, which are full stroke lobes, and lobes 98, 100, which are partial stroke lobes. Since the cam 58 will remain stationary relative to the valve plate 70, it is shown in FIG. 3A that the valve ports 78, 86 will communicate with cylinders 52, 56 when they move on the partial stroke lobes 98, 100. Similarly, the valve ports 82, 90 will communicate with cylinders 52, 56 when they move on the full stroke lobes 94, 96. The remaining four valve ports 80, 84, 88, 92 are connected to the low pressure port 66 continuously. As noted above, the hydraulic machine 42 is configured as a three-speed machine, capable of operating at three different speeds as a motor, and capable of outputting three different flow rates when operating as a pump.

Continuing to use the example of the hydraulic machine 42 operating as a motor, as its components are shown in FIG. 3A, a change in the speed of operation can be effected by changing which of the valve ports 78 92 are connected to the high pressure port 64, and which of them are connected to the low pressure port 66. In order to effect this change, first and second control valves, such as spool/poppet valves 102, 104 are used—see FIG. 2B. It is worth noting that in the example given herein, two spool/poppet valves 102, 104 are used, though in other embodiments, greater or fewer than two can be used. As explained below, the two spool/poppet valves 102, 104, each having two positions, facilitate operation of the hydraulic machine 42 at three different discrete displacements/speeds. For a two displacement/speed machine, a single spool/poppet valve can be used, and for a machine operable at more than three displacements/speeds, more than two spool/poppet valves may be used.

To facilitate an increase in speed of the hydraulic machine 42 as its components are shown in FIG. 3A, the spool/poppet valve 104 is moved to a position such that the full stroke ports 82, 90 are connected full time to the low pressure port 66. This causes the hydraulic machine 42 to operate with, for example, 38.2% displacement, or stated another way, when it is operating as a motor, for a given fluid flow rate the speed of the hydraulic machine 42 will be 2.62 times its operating speed at full displacement. If the spool/poppet valve 102 is moved such that the two partial stroke valve ports 78, 86 are connected to the low pressure port 66, instead of the high pressure port 64, and the spool/poppet valve 104 is positioned to connect the full stroke valve ports 82, 90 to the high pressure port 64, then the hydraulic machine 42 will operate with, for example, 61.8% displacement. In this situation, when the hydraulic machine 42 is operating as a motor, its speed will be 1.62 times the speed of a full displacement motor for a given flow rate.

To complete the example, FIG. 3B shows components of the hydraulic machine 42 configured for operation as a pump. In this example, the valve plate 70 has been rotated 45° clockwise as compared to its position in FIG. 3A. Also shown in FIG. 3B, the cam 58 has retained its position, such that the cam lobes 94, 96, 98, 100, are in the same position they were when the hydraulic machine 42 was operating as a motor. As shown in FIG. 3B, components of the hydraulic machine 42 are configured to facilitate operation of the hydraulic machine 42 with full displacement, such that the valve ports 82, 90, corresponding to full stroke cam lobes 94, 96, are connected to the high pressure port 64 as the corresponding pistons 48, 54 move between BDC and TDC. Similarly, the valve ports 78, 86 corresponding to partial stroke cam lobes 98, 100 are also connected to the high pressure port 64.

When the spool/poppet valve 104 is moved to a position such that the valve ports 82, 90 are connected full time to the low pressure port 66, the hydraulic machine 42 will operate at 38.2% of its full displacement. Similarly, when the spool/poppet valve 102 is moved to a position such that the partial stroke valve ports 78, 86 are connected full-time to the low pressure port 66, and the spool/poppet valve 104 is positioned to connect the full stroke valve ports 82, 90 to the high pressure port 64, the hydraulic machine 42 will operate at 61.8% of its full displacement.

It is worth noting that two of the full-time low pressure valve plate ports 80, 88 are of substantially equal size. Conversely, the low pressure valve plate port 84 is shorter than the ports 80, 88, and the low pressure valve plate port 92 is longer than the low pressure ports 80, 88. As described above, the change from high pressure to low pressure can be made to occur so that all of the cylinders do not experience this change simultaneously. Offsets in the port spacing correspond to offsets in their respective cam lobes, and result in spacing "events" occurring individually. Although the port lengths differ, the space between them is generally uniform, thus ensuring that at least one of them will always be in communication with at least one of the cylinders 52, 56, thereby avoiding a "hydraulic lock" effect.

Although FIG. 2B is representative of the configuration of a pump/motor, such as the hydraulic machine 42, the cross-sectional drawing shown in FIG. 2B actually shows two different support mechanisms, which would typically not be used together, rather, one or the other would be chosen. Specifically, a tapered roller bearing 106 is shown supporting the cylinder block 50 near the bottom of the block 50 as shown in the drawing figure. The tapered roller bearing 106 is configured to handle not only radial loads, such as the load caused by the rotation of the cylinder block 50, but also thrust loads, such as the loads caused by the introduction of high pressure fluid through the high pressure fluid port 64 in the port housing 68.

Although the tapered roller bearing 106 may provide an acceptable mechanism for supporting the cylinder block 50, an alternative is also shown in FIG. 2B. Near the top of the drawing figure is a smaller ball bearing 108, configured to handle radial loads and some light thrust loads. The ball bearing 108 has a lighter duty rating as compared to the larger tapered roller bearing 106, but is less expensive and less complex, because it is not required to also handle large thrust loads. In order to support the cylinder block 50 in the face of the axial thrust loads caused by the high pressure fluid entering the port housing 68, a small balance piston 110 is used—see FIG. 4.

Figure 4:
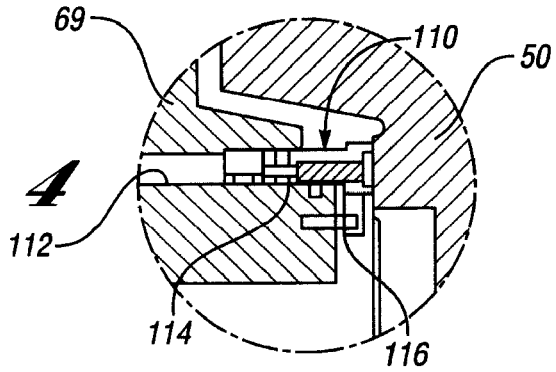
FIG. 4 is a detailed view of a balance piston arrangement as part of the hydraulic machine shown in FIG. 2B.

As shown in FIG. 4, high pressure fluid can be fed to the back of the piston 110 through a high pressure feed line 112. The high pressure feed line 112 has a cross-sectional area slightly smaller than the face of the piston 110. An orifice 114 in the piston 110 provides a restricted flow passage, such that there is a pressure drop in the fluid entering from the high pressure feed line 112. The pressure drop is proportional to the square of the flow velocity through the orifice 114. This allows the balance piston 110 to find a position such that the full pressure times the apply area equals the separating area times the reduced pressure.

The position of the balance piston 110 is self-regulating. If leakage in the hydraulic machine 42 increases, the separating pressure drops, and the piston 110 moves to decrease the operating gap. Conversely, if the leakage in the hydraulic machine 42 decreases, the separating pressure increases, and the piston 110 moves to increase the operating gap. The design of the orifice 114 is adjusted to minimize the loss due to high pressure fluid leakage while maintaining a film of fluid between the rotating cylinder block 50 and the stationary balance piston 110. Also shown in FIG. 4 is a tab 116 mounted to the outer housing 69, and provided to keep the piston 110 from rotating along with the cylinder block 50.

Figure 5:
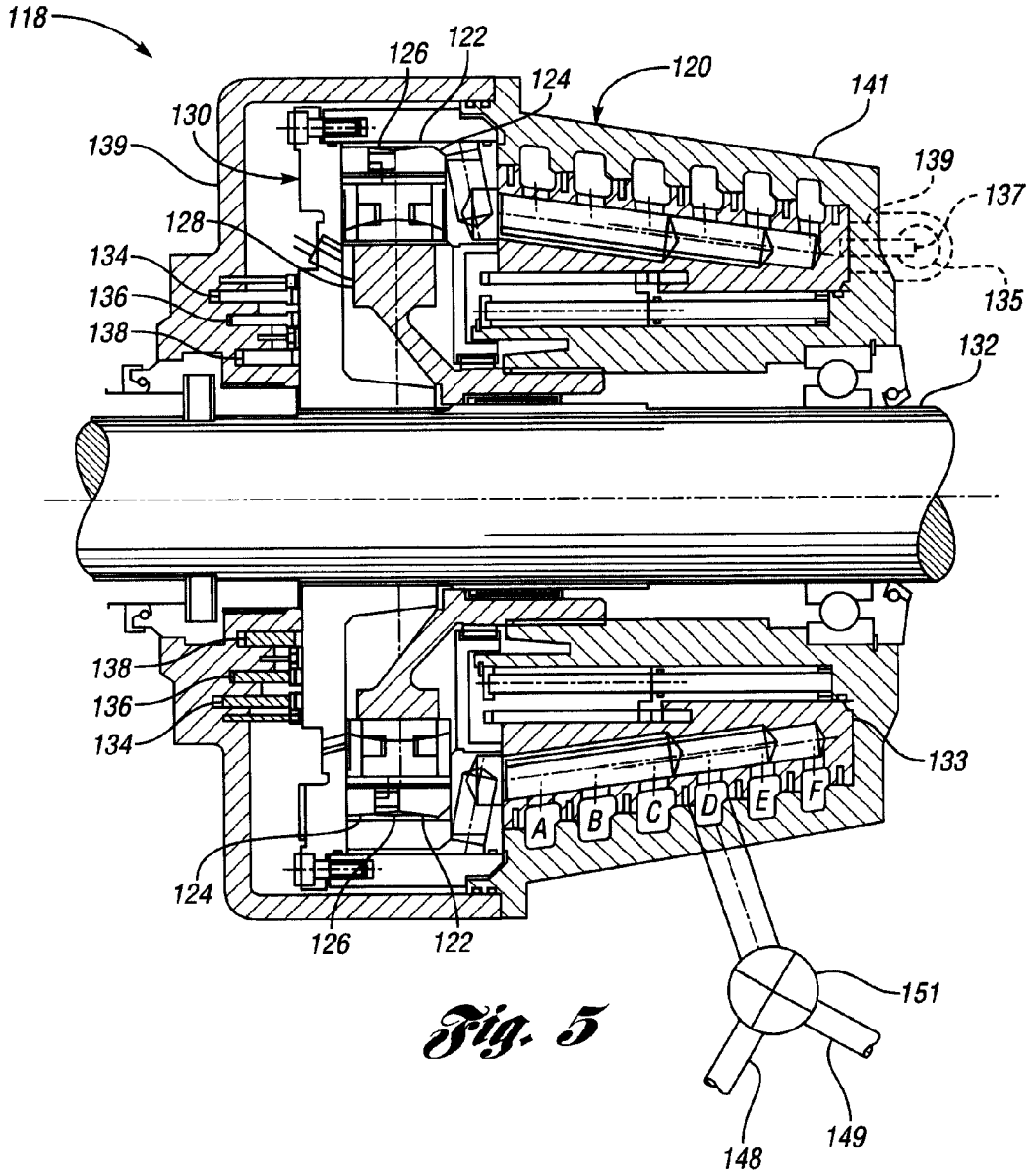
FIG. 5 is a sectional view of a hydraulic machine arrangement in accordance with another embodiment of the present invention.
Figure 6B:
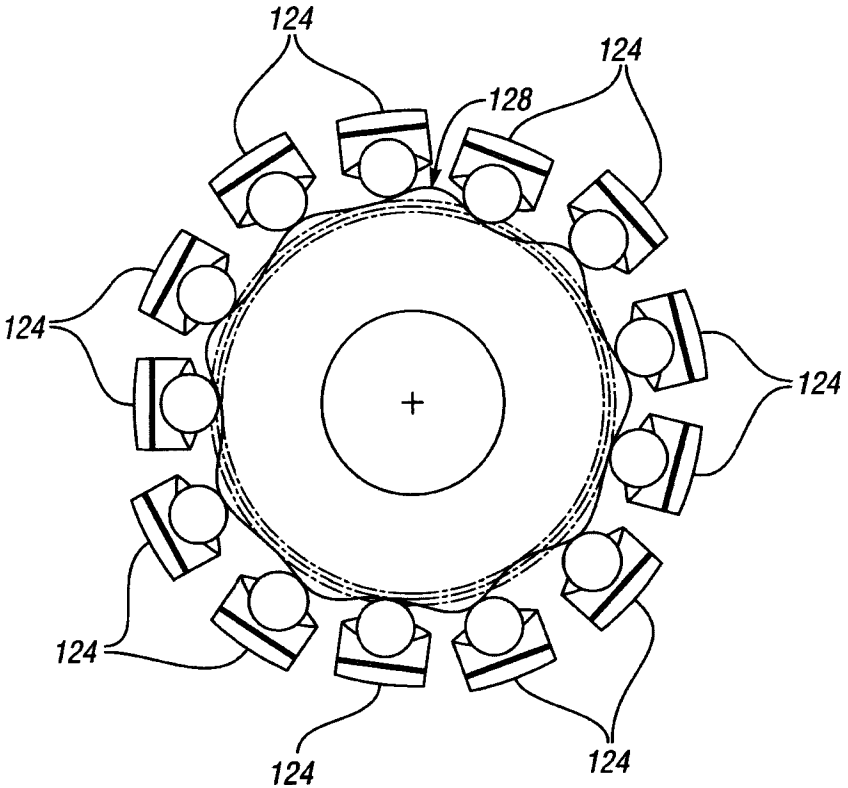
FIGS. 6A-6B are front plan views of a cam and pistons of the hydraulic machine arrangement shown in FIG. 3.
Figure 6A:
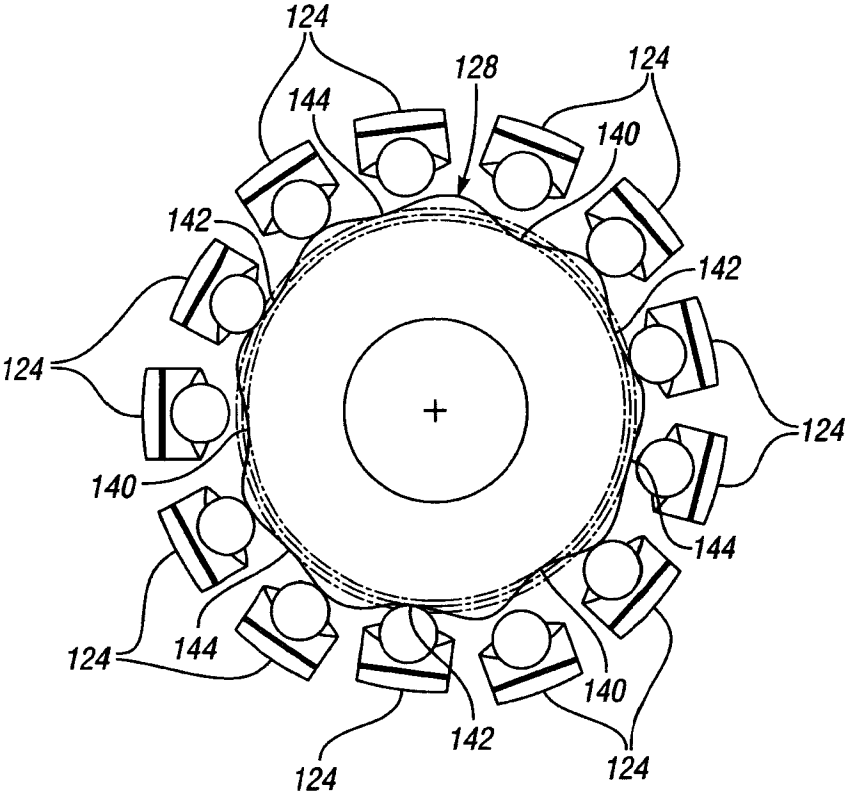

FIG. 5 shows another embodiment of a hydraulic machine arrangement 118 in accordance with the present invention. The hydraulic machine arrangement 118 includes a single hydraulic machine 120, which, as explained in detail below and in conjunction with FIGS. 6A and 6B, is a seven speed machine configured with a 9 lobe cam and 13 cylinders, such as described in summary above. As shown in FIG. 5, the hydraulic machine 120 includes 13 cylinders 122, only two of which are visible in FIG. 5. In each of the cylinders 122 is a corresponding piston 124, which, as explained below in conjunction with FIGS. 9A and 9B, include a small piston 126 inside the head of the main piston 124.

The hydraulic machine 120 also includes a 9 lobe cam 128, which actuates, or is actuated by, the pistons 124 inside a cylinder block 130. Similar to the hydraulic machine 42 described above, the cylinder block 130 rotates with a shaft 132, while the cam 128 remains stationary. The hydraulic machine 120 also includes a port housing 133, which contains three low pressure ports A, C and E, and three high pressure ports B, D and F. Although an axial piston arrangement such as described above for the hydraulic machine 42 shown in FIG. 2B may be used to move the port housing 133 relative to a valve plate 131, a tangential piston 135, illustrated in phantom, my be used as an alternative. In this case, the tangential piston 135 moves the port housing 133 via a pin 137 through a slot 139 in housing 141.

As described above, the hydraulic machine 42 illustrated in FIG. 2B included a balance piston 110 used to counter axial forces. In the hydraulic machine 120, three such balance pistons 134, 136, 138 are contained within an outer housing 139 of the hydraulic machine 120. Shown in sectional view in FIG. 5, each of the balance pistons 134, 136, 138 is connected to one of the high pressure ports B, D, F, and carries a portion of the axial load, thereby eliminating the need for a costly thrust bearing.

As shown in FIGS. 6A and 6B, the 9 lobe cam 128 includes one set of 3 deep lobes 140, one set of 3 intermediate lobes 142, and one set of 3 shallow lobes 144. At any given time, one or more of the pistons 124 can be disengaged from its respective lobe, such that the hydraulic machine 120 operates at less than full displacement. With the 9 lobe cam 128, the hydraulic machine 120 can be operated at seven discrete displacements. In particular some of the pistons 124 can be disengaged from their respective cam lobes, such that those pistons 124 do not contribute to the output of the hydraulic machine 120. Listed below are seven displacements at which the hydraulic machine 120 can be operated. In each case, the group of lobes 140, 142, 144 in contact with respective pistons 124 is listed, along with the percentage of full displacement:

1. 3 shallow lobes 144=16.1%
2. 3 intermediate lobes 142=25.8% (FIG. 6A)
3. 3 shallow lobes 144 and 3 intermediate lobes 142=41.9%
4. 3 deep lobes 140=58.1%
5. 3 shallow lobes 144 and 3 deep lobes 140=74.2%
6. 3 intermediate lobes 142 and 3 deep lobes 140=83.9%
7. All 9 lobes 140, 142, 144=100% (FIG. 6B)

In an alternative cam design, where the 3 deep lobes produce less displacement than the sum of the 3 shallow and 3 intermediate lobes, numbers 3 and 4 in the above list would be reversed to give a smooth progression. In each of the seven cases listed above, it is assumed that each of the pistons 124 not in contact with a respective lobe 140, 142, 144 will be disengaged by one of a number of mechanisms contemplated by the present invention. For example, as described above, the pressure inside the cylinder block 130 can be increased to be approximately equal to the low pressure fluid, for example, as provided by the low pressure accumulator 30 shown in FIG. 1. One way to achieve this when the hydraulic machine 42 is operating as a motor is to use a valve 146, shown in phantom in FIG. 1. The valve 146 is connected between the hydraulic machine arrangement 14 and the low pressure accumulator 130, and can regulate flow back into the hydraulic machine arrangement 14 to substantially equalize the pressure on certain pistons to disengage them.

With regard to the hydraulic machine 120 shown in FIG. 5, another way to disengage certain of the pistons 124 is illustrated. By connecting to an exhaust line 148 one or more of the cylinders 122 that are associated with particular cam lobes 140, 142, 144, corresponding pistons 124 are disengaged. As shown in FIG. 5, port D is selectively connectable with the exhaust line 148 and a high pressure line 149 by using a control valve, such as a two-way poppet valve 151. Although the remaining exhaust and pressure lines are not shown in FIG. 5 for clarity, it is understood that each of the ports B and F would be selectively connectable between an exhaust line and a high pressure line, while each of the ports A, C and E would be selectively connectable between an exhaust line and a low pressure line.

With a control valve controlling each port, any combination of ports can be exhausted when not required for a desired displacement. For example, if the minimum pump displacement is desired, the A, B, C, and D are connected to exhaust to deactivate those cam lobes. If minimum motor displacement is desired, then B, C, D, and E are connected to exhaust. Partial displacement, and in particular, almost maximum displacement, would exhaust A and F. Because of this indexing, no two ports are paired in the same way for pump and motor operation. Therefore, six two-way poppet valves can be used to control the displacement for all conditions of pump and motor operation. The following chart shows the passage connections with the six ports for both pump and motor modes.

| | PUMP | | MOTOR | |
|---|---|---|---|---|
| Cam ramps | High Pressure | Low Pressure | High Pressure | Low Pressure |
| Deep Down | | A | B | |
| Deep Up | B | | | C |
| Interm. Down | | C | D | |
| Interm. Up | D | | | E |
| Shallow Down | | E | F | |
| Shallow Up | F | | | A |

Figure 7:
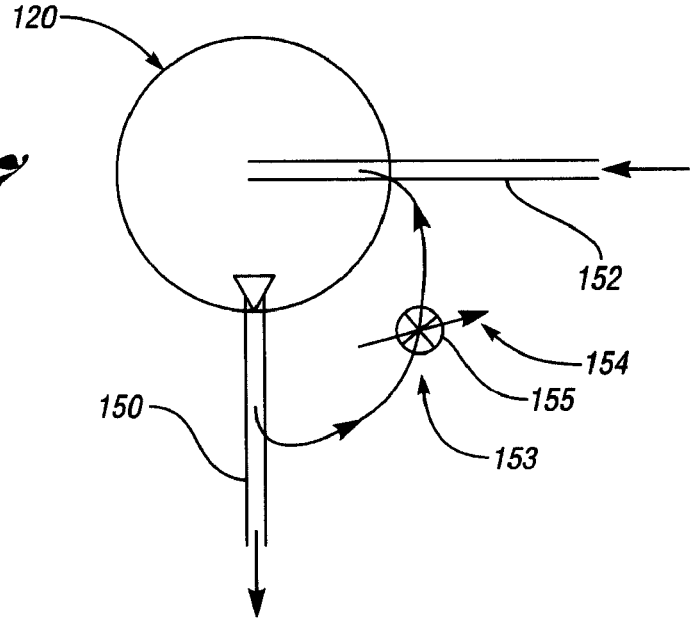
FIG. 7 is a schematic representation of a hydraulic machine arrangement in accordance with an embodiment of the present invention, including a jet pump used to effect variable displacement of a hydraulic machine operating as a pump.

As described above, another way to disengage pistons, such as the pistons 124, to effect variable displacement is to disengage the non-driving pistons by decreasing the return pressure to near zero by using a high capacity pump, such as a jet pump. FIG. 7 schematically illustrates the hydraulic machine 120, and its connection to a high pressure line 150 and a low pressure line 152. As illustrated in FIG. 7, the hydraulic machine 120 is operating as a pump, and therefore, the high pressure line 150 would be connected to one or more of ports B, D and F illustrated in FIG. 5, and is labeled "INLET". Similarly, the low pressure line 152 would be connected to one or more of ports A, C and E illustrated in FIG. 5, and is labeled "OUTLET". A pump arrangement 153, including a jet pump 154, siphons off some of the fluid exiting through the outlet, and recirculates it back into the inlet. The more fluid that is removed from the outlet, the lower the effective displacement of the hydraulic machine 120.

Figure 8:
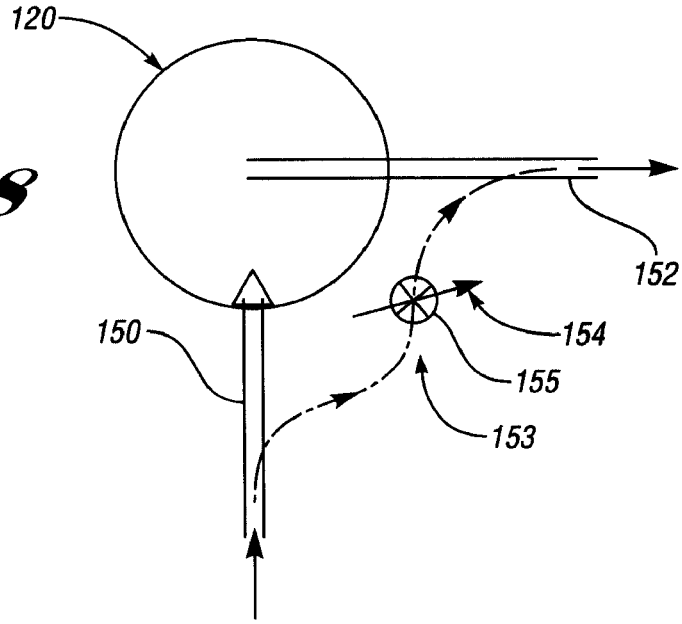
FIG. 8 is a schematic representation of a hydraulic machine arrangement in accordance with an embodiment of the present invention, including a jet pump used to effect variable displacement of a hydraulic machine operating as a motor.

In FIG. 8, the hydraulic machine 120 is operating as a motor; therefore, the jet pump 154 is used to take fluid from the high pressure line 150, which is now the inlet, and pump it into the low pressure line 152, which is now the outlet. Reducing the inlet pressure on at least some of the cylinders 122 lowers the torque output by the hydraulic machine 120. In each case, the pump arrangement 153 includes a valve 155, which is operable to throttle and thereby control the redirected flow and the amount of variation in the displacement.

As described above, a jet pump arrangement, such as the jet pump arrangement 153, can also be used to disengage certain cylinders when a hydraulic machine is operating as a motor. Again using FIG. 8 as a schematic illustration, a minimum amount of fluid is now diverted from the inlet to the outlet—keeping in mind that the "outlet" is one or more of the low pressure fluid ports. The pressure downstream from the outlet may be similar to the pressure without the use of the jet pump 154, but the pressure at the intersection of the outlet and the hydraulic machine 120 will be reduced—in some cases close to zero.

In this way respective pistons 124 are disengaged, being subject to the centrifugal force of the rotating port housing 133. The hydraulic machine 120 operates at less than full displacement, thereby allowing the hydraulic machine 120 to operate at an increased speed. With a fixed displacement hydraulic machine, the speed is limited by the maximum amount of fluid flow through the machine. This has limited applications, for example, slow speed, off road vehicles. In contrast, embodiments of the present invention provide hydraulic machines having variable displacements effected by disengaging some of the pistons, thereby making them suitable for high speed, on highway vehicles.

Figure 9B:
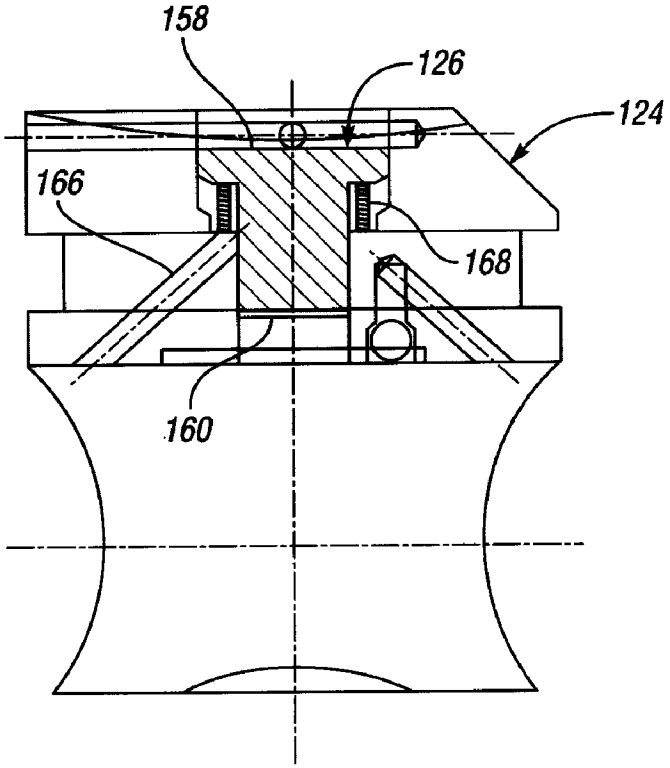
FIGS. 9A-9B are front and side views of a dual piston configuration used with the hydraulic machine arrangement shown in FIG. 5.
Figure 9A:
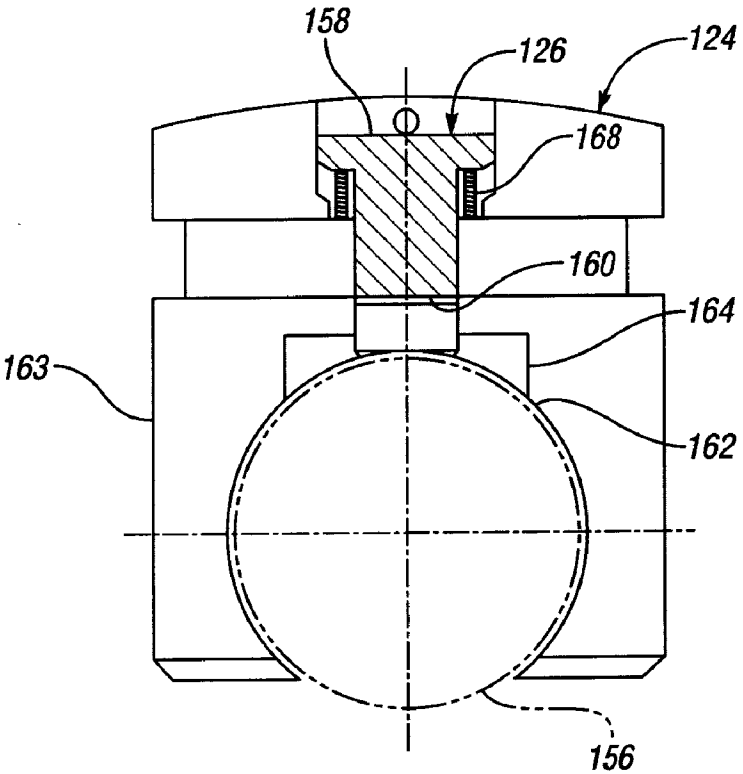

One issue that may need to be addressed with regard to the function of a radial piston hydraulic machine, is the output of an undesirably low torque when the machine is initially started. This can be a result of friction between a cam follower, and a piston head. One possible solution to this is to use the dual piston head configuration shown in FIG. 5. Specifically, having the small piston 126 inside the larger piston 124 addresses this issue. Illustrated in detail in FIGS. 9A and 9B are the pistons 124, 126 with a cam follower 156 associated with the piston 124 shown in phantom. The second piston 126 is used to help force hydraulic fluid toward the cam follower 156 to reduce friction. As shown in FIGS. 9A and 9B, an upper surface 158 of the piston 126 has a larger area than a lower surface 160. In this way, a force exerted on the upper surface 158 will transmit a higher pressure downward toward the cam follower 156. Fluid is forced into the interface 162 between the cam follower 156 and the head of the piston 124, causing the cam follower 156 to "lift off" of piston journal bearing 163.

As shown in FIG. 9A, a counterbore 164 is formed in the piston 124 to provide a larger surface area for the hydraulic fluid. As shown in FIG. 9B, the piston 124 also includes a vent line 166 which can allow fluid to escape from underneath the small piston 126. In addition, the small piston 126 is configured with a spring 168 which allows the piston 126 to return to a top dead center position when the fluid pressure from the top surface 158 is released.

Figure 10:
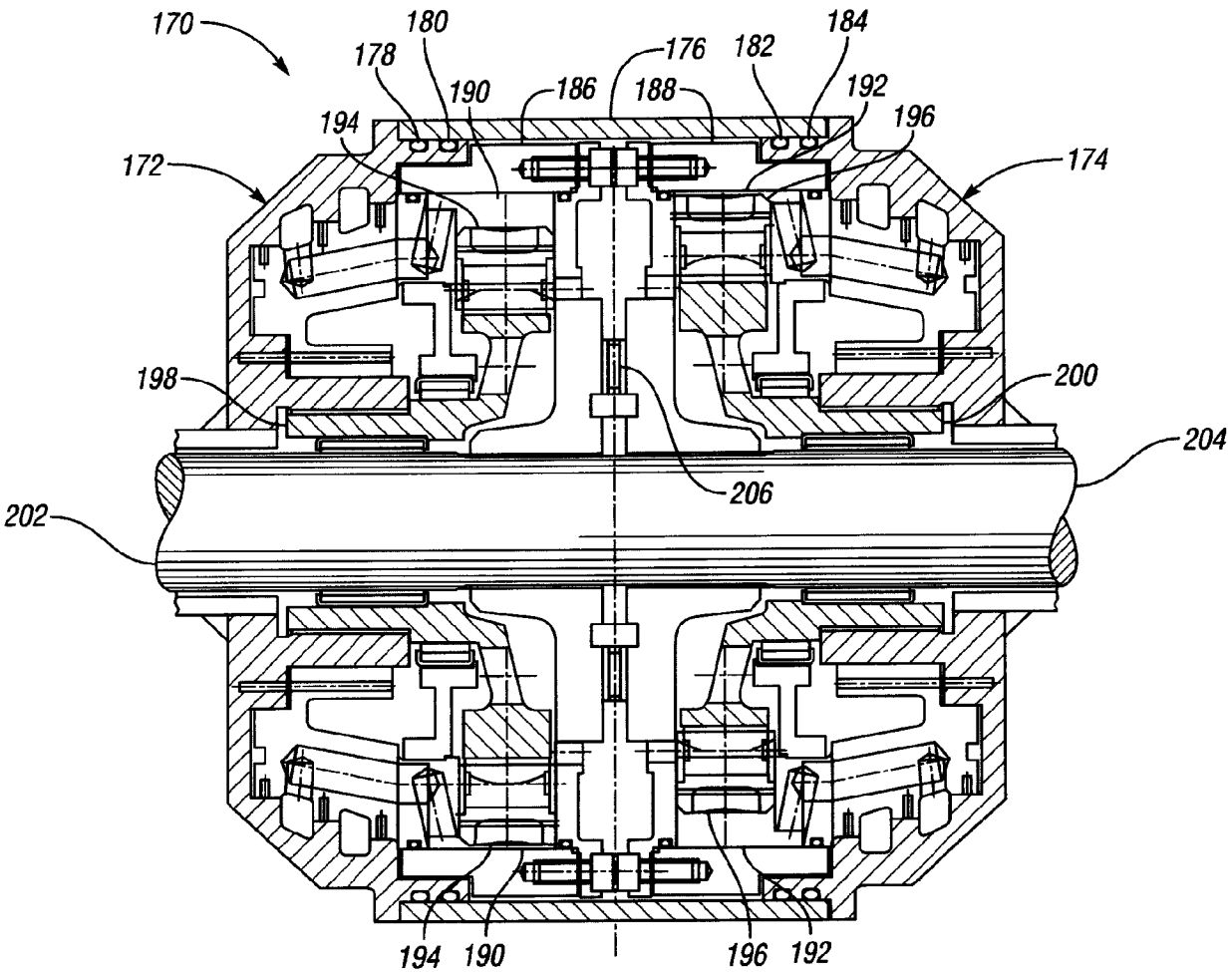
FIG. 10 is a sectional view of a hydraulic machine arrangement in accordance with the present invention, including two hydraulic machines arranged back-to-back.

FIG. 10 shows a hydraulic machine arrangement 170 in accordance with another embodiment of the present invention. The hydraulic machine arrangement 170 includes two, back-to-back hydraulic machines 172, 174, which may be, for example, substantially configured as either of the two hydraulic machines 42, 120 illustrated and described above. The hydraulic machines 172, 174 are sealed within a housing 176 by O-ring seals 178, 180, 182, 184 disposed between the housing and the hydraulic machines 172, 174. Each of the hydraulic machines 172, 174 includes a respective cylinder block 186, 188 containing a plurality of corresponding cylinders 190, 192, only two of which are visible for each of the hydraulic machines 172, 174. Each of the cylinders 190, 192 contains a corresponding piston 194, 196, driven by, or driving, a corresponding cam 198, 200.

Each of the cylinder blocks 186, 188 is attached to a respective shaft 202, 204, which may be, for example, axle shafts, such as the half axle shafts 31, 33 illustrated in FIG. 1. As described above, there are a number of ways of axially supporting a single hydraulic machine—e.g., thrust bearings and balance pistons, just to name two. In the case of two hydraulic machines in a back-to-back configuration, such as shown in FIG. 10, each of the hydraulic machines 172, 174 provides support for the other. Thus, for the hydraulic machine arrangement 170, the load requirement for bearing 206 is decreased. Although the loads on the bearing 206 are high, the relative speed between the two axle shafts 202 and 204 is low.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A hydraulic machine arrangement including a hydraulic machine operable in at least one of two modes, a first mode being a pump mode, wherein the hydraulic machine can be driven by mechanical energy to increase the pressure of fluid flowing through the hydraulic machine, and a second mode being a motor mode, wherein the hydraulic machine can be driven by pressurized fluid to provide output torque, the hydraulic machine arrangement comprising:

a port housing including a high pressure fluid port, a low pressure fluid port, and an exhaust port;

a cylinder block in fluid communication with the port housing and including a plurality of cylinders therein;

a plurality of radial pistons, each of the pistons being configured to reciprocate within a corresponding cylinder in the cylinder block, the pistons pumping fluid when the hydraulic machine is operating in the pump mode, and providing torque when the hydraulic machine is operating in the motor mode, each of the pistons including a corresponding cam follower;

a cam disposed inboard of the pistons, and having a plurality of lobes configured to cooperate with the cam followers such that effecting a relative rotational motion between the cam and the cylinder block effects linear motion of the pistons when the hydraulic machine is operating in the pump mode, and effecting linear motion of the pistons effects a relative rotational motion between the cam and the cylinder block when the hydraulic machine is operating in the motor mode, at least one of the lobes having a first profile to effect a full stroke movement of a corresponding piston, and at least one other of the lobes having a second profile shallower than the first profile to effect a partial stroke movement of a corresponding piston;

a first control valve associated with the high pressure fluid port and the exhaust port, the first control valve being movable between first and second positions, the first position of the first control valve facilitating fluid flow between the high pressure port and at least one cylinder, the second position of the first control valve facilitating fluid flow between the exhaust port and the at least one cylinder, thereby disengaging a respective piston in the at least one cylinder from the cam;

a second control valve associated with the low pressure fluid port and the exhaust port, the second control valve being movable between first and second positions, the first position of the second control valve facilitating fluid flow between the low pressure port and at least one other cylinder, the second position of the second control valve facilitating fluid flow between the exhaust port and the at least one other cylinder, thereby disengaging a respective piston in the at least one other cylinder from the cam, movement of at least one of the first or second control valves between its respective first and second positions effecting discrete variation in the displacement of the hydraulic machine; and a valve plate including a plurality of apertures therethrough, at least one of the apertures communicating with the first control valve and at least one other of the apertures communicating with the second control valve, the valve plate being configured to connect the at least one cylinder with the first control valve and the at least one other cylinder with the second control valve, the valve plate and the port housing being movable relative to each other to effect a first transition to disconnect the at least one cylinder from the first control valve and connect it with the second control valve, and to effect a second transition to disconnect the at least one other cylinder from the second control valve and connect it with the first control valve.

2. The hydraulic machine arrangement of claim 1, wherein the hydraulic machine is operable with seven discrete displacements, the port housing including three of the high pressure ports and three of the low pressure ports, the cam including nine lobes, three of the lobes having the first profile, three other of the lobes having the second profile, and the remaining three lobes having a third profile deeper than the second profile and shallower than the first profile to effect an intermediate stroke movement of a corresponding piston, the hydraulic machine arrangement further comprising:

thirteen of the pistons;

three of the first control valves, each being associated with one of the three high pressure ports and the exhaust port; and three of the second control valves, each being associated with one of the three low pressure ports and the exhaust port.

3. The hydraulic machine arrangement of claim 1, wherein each of the pistons includes a respective secondary piston at least partially disposed therein, each of the secondary pistons being configured to force fluid toward a corresponding cam follower to at least temporarily reduce friction between the cam follower and the piston.

4. The hydraulic machine arrangement of claim 1, further comprising:

an outer housing at least partially surrounding the cylinder block, and a balance piston at least partially disposed within the outer housing and configured to apply a force to the cylinder block to substantially balance an opposite force to the cylinder block applied by fluid entering the cylinder block through the high pressure port in the port housing.

5. The hydraulic machine arrangement of claim 4, further comprising a plurality of the balance pistons.

6. The hydraulic machine arrangement of claim 1, further comprising two of the hydraulic machines contained in a single housing and disposed such that each of the hydraulic machines at least partly offsets axial forces imposed on the other hydraulic machine.

7. The hydraulic machine arrangement of claim 6, further comprising a thrust bearing disposed between the two hydraulic machines.

8. A hydraulic machine arrangement including a hydraulic machine having high and low pressure sides and being operable in at least one of two modes, a first mode being a pump mode, wherein the hydraulic machine can be driven by mechanical energy to increase the pressure of fluid flowing through the hydraulic machine, and a second mode being a motor mode, wherein the hydraulic machine can be driven by pressurized fluid to provide output torque, the hydraulic machine arrangement comprising:

a port housing including a high pressure fluid port on the high pressure side of the hydraulic machine and a low pressure fluid port on the low pressure side of the hydraulic machine;

a cylinder block in fluid communication with the port housing and including a plurality of cylinders therein;

a plurality of radial pistons, each of the pistons being configured to reciprocate within a corresponding cylinder in the cylinder block, the pistons pumping fluid when the hydraulic machine is operating in the pump mode, and providing torque when the hydraulic machine is operating in the motor mode, each of the pistons including a corresponding cam follower;

a cam disposed inboard of the pistons, and having a plurality of lobes configured to cooperate with the cam followers such that effecting a relative rotational motion between the cam and the cylinder block effects linear motion of the pistons when the hydraulic machine is operating in the pump mode, and effecting linear motion of the pistons effects a relative rotational motion between the cam and the cylinder block when the hydraulic machine is operating in the motor mode, at least one of the lobes having a first profile to effect a full-stroke movement of a corresponding piston, and at least one other of the lobes having a second profile shallower than the first profile to effect a partial stroke movement of a corresponding piston;

a valve plate including a plurality of apertures therethrough, at least one of the apertures communicating with the high pressure fluid port and at least one other of the apertures communicating with the low pressure fluid port, the valve plate being configured to connect at least one of the cylinders with the high pressure fluid port and at least one other of the cylinders with the low pressure fluid port, the valve plate and the port housing being movable relative to each other to effect a first transition to disconnect the at least one cylinder from the high pressure fluid port and connect it with the low pressure fluid port, and to effect a second transition to disconnect the at least one other cylinder from the low pressure fluid port and connect it with the high pressure fluid port; and a pump arrangement including a pump disposed between the high pressure side and the low pressure side of the hydraulic machine, and configured to pump some of the fluid from the high pressure side to the low pressure side, thereby facilitating variable displacement operation of the hydraulic machine.

9. The hydraulic machine arrangement of claim 8, wherein the pump arrangement is configured to remove fluid output by the hydraulic machine when the hydraulic machine is operating in the pump mode, and to remove fluid before it enters the hydraulic machine when the hydraulic machine is operating in the motor mode.

10. The hydraulic machine arrangement of claim 8, wherein the pump arrangement is configured to reduce the pressure differential across the hydraulic machine for at least one of the cylinders when the hydraulic machine is operating as a motor, thereby selectively disengaging a corresponding piston from the cam for less than full displacement operation of the hydraulic machine.

11. The hydraulic machine arrangement of claim 8, wherein the pump arrangement further includes a valve configured to control the flow of fluid through the pump.

12. The hydraulic machine arrangement of claim 8, further comprising:

an outer housing at least partially surrounding the cylinder block, and a balance piston at least partially disposed within the outer housing and configured to apply a force to the cylinder block to substantially balance an opposite force to the cylinder block applied by fluid entering the cylinder block through the high pressure port in the port housing.

13. The hydraulic machine arrangement of claim 12, further comprising a plurality of the balance pistons.

14. The hydraulic machine arrangement of claim 8, further comprising two of the hydraulic machines contained in a single housing and disposed such that each of the hydraulic machines at least partly offsets axial forces imposed on the other hydraulic machine.

15. The hydraulic machine arrangement of claim 8, wherein each of the pistons includes a respective secondary piston at least partially disposed therein, each of the secondary pistons being configured to force fluid toward a corresponding cam follower to at least temporarily reduce friction between the cam follower and the piston.

16. The hydraulic machine arrangement of claim 8, further comprising a plurality of the high pressure ports and a plurality of the low pressure ports.

17. A hydraulic machine arrangement including a hydraulic machine having high and low pressure sides and being operable in at least one of two modes, a first mode being a pump mode, wherein the hydraulic machine can be driven by mechanical energy to increase the pressure of fluid flowing through the hydraulic machine, and a second mode being a motor mode, wherein the hydraulic machine can be driven by pressurized fluid to provide output torque, the hydraulic machine arrangement comprising:

a port housing including a high pressure fluid port on the high pressure side of the hydraulic machine and a low pressure fluid port on the low pressure side of the hydraulic machine;

a cylinder block in fluid communication with the port housing and including a plurality of cylinders therein;

a plurality of radial pistons, each of the pistons being configured to reciprocate within a corresponding cylinder in the cylinder block, the pistons pumping fluid when the hydraulic machine is operating in the pump mode, and providing torque when the hydraulic machine is operating in the motor mode, each of the pistons including a corresponding cam follower;

a cam disposed inboard of the pistons, and having a plurality of lobes configured to cooperate with the cam followers such that effecting a relative rotational motion between the cam and the cylinder block effects linear motion of the pistons when the hydraulic machine is operating in the pump mode, and effecting linear motion of the pistons effects a relative rotational motion between the cam and the cylinder block when the hydraulic machine is operating in the motor mode, at least one of the lobes having a first profile to effect a full stroke movement of a corresponding piston, and at least one other of the lobes having a second profile shallower than the first profile to effect a partial stroke movement of a corresponding piston;

a valve plate including a plurality of apertures therethrough, at least one of the apertures communicating with the high pressure fluid port and at least one other of the apertures communicating with the low pressure fluid port, the valve plate being configured to connect at least one of the cylinders with the high pressure fluid port and at least one other of the cylinders with the low pressure fluid port, the valve plate and the port housing being movable relative to each other to effect a first transition to disconnect the at least one cylinder from the high pressure fluid port and connect it with the low pressure fluid port, and to effect a second transition to disconnect the at least one other cylinder from the low pressure fluid port and connect it with the high pressure fluid port; and a means for disengaging at least one of the pistons from the cam, thereby facilitating operation of the hydraulic machine at less than full displacement.

18. The hydraulic machine arrangement of claim 17, wherein the port housing further includes an exhaust port, the means for disengaging at least one of the pistons from the cam including a control valve disposed between one of the high pressure fluid port and the exhaust port, or the low pressure fluid port and the exhaust port, the control valve being configured to effect disengagement of the at least one piston by exhausting fluid from a respective cylinder of the at least one piston.

19. The hydraulic machine arrangement of claim 17, wherein the means for disengaging at least one of the pistons from the cam includes a pump arrangement including a pump disposed between the high pressure side and the low pressure side of the hydraulic machine, and configured to pump some of the fluid from the high pressure side to the low pressure side, thereby substantially equalizing the pressure in a respective cylinder of the at least one piston.

20. The hydraulic machine arrangement of claim 17, further comprising two of the hydraulic machines contained in a single housing and disposed such that each of the hydraulic machines at least partly offsets axial forces imposed on the other hydraulic machine.

21. The hydraulic machine arrangement of claim 17, further comprising a tangential piston configured to move the port housing relative to the valve plate to effect the transitions between the cylinders and the high and low pressure fluid ports.

* * * * *